US011443668B2

(12) United States Patent
Xu et al.

(10) Patent No.: US 11,443,668 B2
(45) Date of Patent: Sep. 13, 2022

(54) DRIVING CIRCUIT COMPRISING REDUNDANT CLOCK SIGNAL LINE AND DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventors: Zhida Xu, Shenzhen (CN); Ilgon Kim, Shenzhen (CN); Bin Zhao, Shenzhen (CN); Xin Zhang, Shenzhen (CN); Jun Zhao, Shenzhen (CN)

( * ) Notice: Subject to any disclaimer, the term of this patent is extended or adjusted under 35 U.S.C. 154(b) by 164 days.

(21) Appl. No.: 16/767,136

(22) PCT Filed: Apr. 23, 2020

(86) PCT No.: PCT/CN2020/086345
§ 371 (c)(1),
(2) Date: May 27, 2020

(87) PCT Pub. No.: WO2021/189586
PCT Pub. Date: Sep. 30, 2021

(65) Prior Publication Data

US 2022/0122504 A1 Apr. 21, 2022

(30) Foreign Application Priority Data

Mar. 22, 2020 (CN) ..... 202010204841.X

(51) Int. Cl.
*G09G 3/20* (2006.01)

(52) U.S. Cl.
CPC ..... *G09G 3/20* (2013.01); *G09G 2310/08* (2013.01)

(58) Field of Classification Search
None
See application file for complete search history.

(56) References Cited

U.S. PATENT DOCUMENTS

2005/0012873 A1* 1/2005 Park ..... G02F 1/13454 349/43
2010/0013743 A1* 1/2010 Cho ..... G02F 1/1345 345/55
2020/0052005 A1* 2/2020 Yoshida ..... H01L 21/3205
(Continued)

FOREIGN PATENT DOCUMENTS

CN 101587266 A 11/2009
CN 103107183 A 5/2013
CN 206470510 U 9/2017
(Continued)

*Primary Examiner* — Amr A Awad
*Assistant Examiner* — Donna V Bocar

(57) ABSTRACT

A driving circuit and a display panel are provided. In a driving circuit structure, a clock signal line group includes a plurality of clock signal lines, the clock signal lines are arranged side by side, and there is a first pitch between two adjacent clock signal lines. A non-high frequency signal line is provided on two sides of the clock signal line group. A redundant clock signal line is disposed between the clock signal line group and the non-high frequency signal line, and a frequency and an amplitude of a signal received by the redundant clock signal line are the same as a frequency and an amplitude of a signal received by the clock signal line.

10 Claims, 3 Drawing Sheets

(56) References Cited

U.S. PATENT DOCUMENTS

2021/0358354 A1* 11/2021 Huang ..... G02F 1/136286

FOREIGN PATENT DOCUMENTS

| | | | |
|---|---|---|---|
| CN | 106269540 | A | 7/2018 |
| CN | 108630162 | A | 10/2018 |
| CN | 109243392 | A | 1/2019 |
| CN | 109712581 | A | 5/2019 |
| JP | 2011090244 | A | 5/2011 |

* cited by examiner

Replacement Sheet

DRIVING CIRCUIT COMPRISING REDUNDANT CLOCK SIGNAL LINE AND DISPLAY PANEL

FIELD OF INVENTION

The present application relates to the field of display technologies, and more particularly to driving circuit and a display panel.

BACKGROUND OF INVENTION

Current 8K (resolution 7680*4320) display panels with 1 gate and 1 data architecture (the same row of sub-pixels is connected to the same scan line and the same column of sub-pixels is connected to the same data line) are extremely sensitive to signal changes. Clock signal lines in the current 8K display panel are generally arranged vertically on both sides of a panel, and a low-frequency signal line A or a DC signal line is provided beside the clock signal lines on left and right sides. As shown in FIG. 1, a lateral coupling effect experienced by a clock signal line CK1 and a clock signal line CK6 is not completely consistent with intermediate clock signal line CK2 to clock signal line CK5. Therefore, a load of the clock signal lines on both sides and a load of the clock signal lines in the middle may be different, which may result in defective horizontal lines of the display panel.

SUMMARY OF INVENTION

Embodiments of the present application provide a driving circuit and a display panel, to solve a technical problem of defective horizontal lines of a display panel caused by different loads of existing clock signal lines.

An embodiment of the present application provides a driving circuit comprising a signal generator; a driving circuit unit; a clock signal line group comprising a plurality of clock signal lines, wherein an input end of the clock signal line is electrically connected to the signal generator, and an output end of the clock signal line is electrically connected to the driving circuit unit, the clock signal lines are arranged side by side, and there is a first pitch between two adjacent clock signal lines; a non-high frequency signal line, wherein an input end of the non-high frequency signal line is electrically connected to the signal generator, and the non-high frequency signal line is provided on two sides of the clock signal line group; and a redundant clock signal line, wherein an input end of the redundant clock signal line is electrically connected to the signal generator; the redundant clock signal line is disposed between the clock signal line group and the non-high frequency signal line; a frequency and an amplitude of a signal received by the redundant clock signal line are the same as a frequency and an amplitude of a signal received by the clock signal line.

In the driving circuit according an embodiment of the present application, the redundant clock signal line has a second pitch with an adjacent clock signal line, and the second pitch is equal to the first pitch.

In the driving circuit according an embodiment of the present application, a thickness of the redundant clock signal line and a thickness of the clock signal line are equal.

In the driving circuit according to an embodiment of the present application, a thickness of the redundant clock signal line and a thickness of the clock signal line are equal.

In the driving circuit according to an embodiment of the present application, a width of the redundant clock signal line is less than or equal to a width of the clock signal line.

In the driving circuit according to an embodiment of the present application, material of the redundant clock signal line is the same as material of the clock signal line.

In the driving circuit according to an embodiment of the present application, the non-high frequency signal line has a third pitch with an adjacent redundant clock signal line, and the third pitch is equal to the second pitch.

In the driving circuit according to an embodiment of the present application, the non-high frequency signal line is a low-frequency signal line or a DC signal line.

In the driving circuit according to an embodiment of the present application, the non-high frequency signal line is a low-frequency signal line, and an output end of the low-frequency signal line is electrically connected to the driving circuit unit or a common electrode.

An embodiment of the present application further provides a display panel comprising a driving circuit disposed in a non-display area of the display panel. The driving circuit comprises a signal generator; a driving circuit unit; a clock signal line group comprising a plurality of clock signal lines, wherein an input end of the clock signal line is electrically connected to the signal generator, and an output end of the clock signal line is electrically connected to the driving circuit unit, the clock signal lines are arranged side by side, and there is a first pitch between two adjacent clock signal lines; a non-high frequency signal line, wherein an input end of the non-high frequency signal line is electrically connected to the signal generator, and the non-high frequency signal line is provided on two sides of the clock signal line group; and a redundant clock signal line, wherein an input end of the redundant clock signal line is electrically connected to the signal generator; the redundant clock signal line is disposed between the clock signal line group and the non-high frequency signal line; a frequency and an amplitude of a signal received by the redundant clock signal line are the same as a frequency and an amplitude of a signal received by the clock signal line.

In the display panel according to an embodiment of the present application, the redundant clock signal line has a second pitch with an adjacent clock signal line, and the second pitch is equal to the first pitch.

In the display panel according to an embodiment of the present application, a thickness of the redundant clock signal line and a thickness of the clock signal line are equal.

In the display panel according to an embodiment of the present application, a width of the redundant clock signal line is less than or equal to a width of the clock signal line.

In the display panel according to an embodiment of the present application, material of the redundant clock signal line is the same as material of the clock signal line.

In the display panel according to an embodiment of the present application, the non-high frequency signal line has a third pitch with an adjacent redundant clock signal line, and the third pitch is equal to the second pitch.

In the display panel according to an embodiment of the present application, the non-high frequency signal line is a low-frequency signal line or a DC signal line.

In the display panel according to an embodiment of the present application, the non-high frequency signal line is a low-frequency signal line, and an output end of the low-frequency signal line is electrically connected to the driving circuit unit or a common electrode.

It should be noted that a structure of the driving circuit of the display panel of an embodiment is the same as a structure of the driving circuit of the above embodiment.

Beneficial Effect

The driving circuit and the display panel of embodiments of the present application add a redundant clock signal line between the clock signal line group and the non-high frequency signal line. A frequency and an amplitude of a signal received by the redundant clock signal line are the same as a frequency and an amplitude of a signal received by the clock signal line, and do not enter the plane. Such an arrangement makes a lateral capacitive coupling of the clock signal lines in the clock signal line group the same. This achieves an effect of balancing a load of each clock signal line, and an image shows no horizontal line defects.

DESCRIPTION OF DRAWINGS

In order to more clearly explain the embodiments of the present application or the technical solutions in the prior art, the following briefly introduces the drawings required in the embodiments. The drawings in the following description are only part of the embodiments of the present application. For those of ordinary skill in the art, without paying any creative efforts, other drawings may be obtained based on these drawings.

DETAILED DESCRIPTION OF PREFERRED EMBODIMENTS

Figure 1:
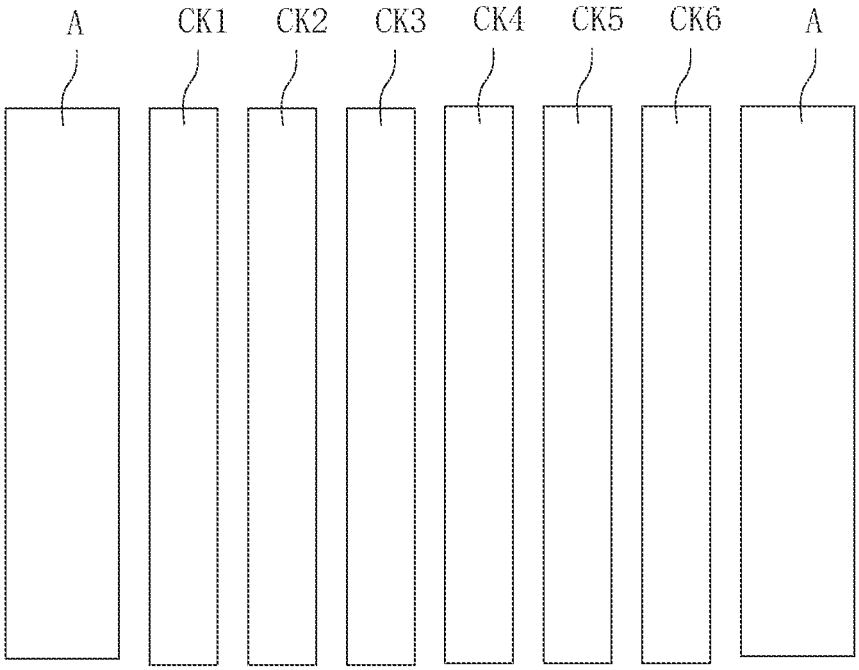
FIG. 1 Prior Art
FIG. 1 is a schematic diagram of a partial structure of a signal line wiring of a conventional driving circuit.

The technical solutions in the embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by those skilled in the art without making creative efforts fall within the protection scope of the present application.

In the description of the present application, it should be understood that the terms "center", "longitudinal", "horizontal", "length", "width", "thickness", "upper", "lower", "front", "rear", "left", "right", "vertical", "level", "top", "bottom", "inner", "outer", "clockwise", "counterclockwise" etc. are positional relationships based on the orientation or positional relationship shown in the drawings. This is only for the convenience of describing the present application and simplifying the description, rather than indicating or implying that the device or element referred to must have a specific orientation, be constructed and operate in a specific orientation, and therefore cannot be construed as limiting the application. In the description of the present application, it should be understood that, terms such as "first" and "second" are used herein for purposes of description and are not intended to indicate or imply relative importance or significance or to imply the number of indicated technical features. Thus, the feature defined with "first" and "second" may comprise one or more of the features. In the description of the present application, "a plurality of" means two or more, unless specified otherwise.

In the description of the present application, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present application.

In the present application, unless explicitly specified and defined otherwise, a first feature being "on" or "under" a second feature may be that the first feature and the second feature are in direct contact, or the first feature and the second feature are in indirect contact through an intermediary. In addition, the first feature being "on", "over" and "above" the second feature may be that the first feature is just above or diagonally above the second feature, or merely represents that a horizontal height of the first feature is higher than that of the second feature. The first feature being "under", "below" and "underneath" the second feature may be that the first feature is just below or diagonally below the second feature, or merely represents that the horizontal height of the first feature is lower than that of the second feature.

Various embodiments and examples are provided in the following description to implement different structures of the present application. In order to simplify the present application, certain elements and settings will be described. However, these elements and settings are only by way of example and are not intended to limit the present application. In addition, reference numerals may be repeated in different examples in the present application. This repeating is for the purpose of simplification and clarity and does not refer to relations between different embodiments and/or settings. Furthermore, examples of different processes and materials are provided in the present application. However, it would be appreciated by those skilled in the art that other processes and/or materials may be also applied.

Figure 2:
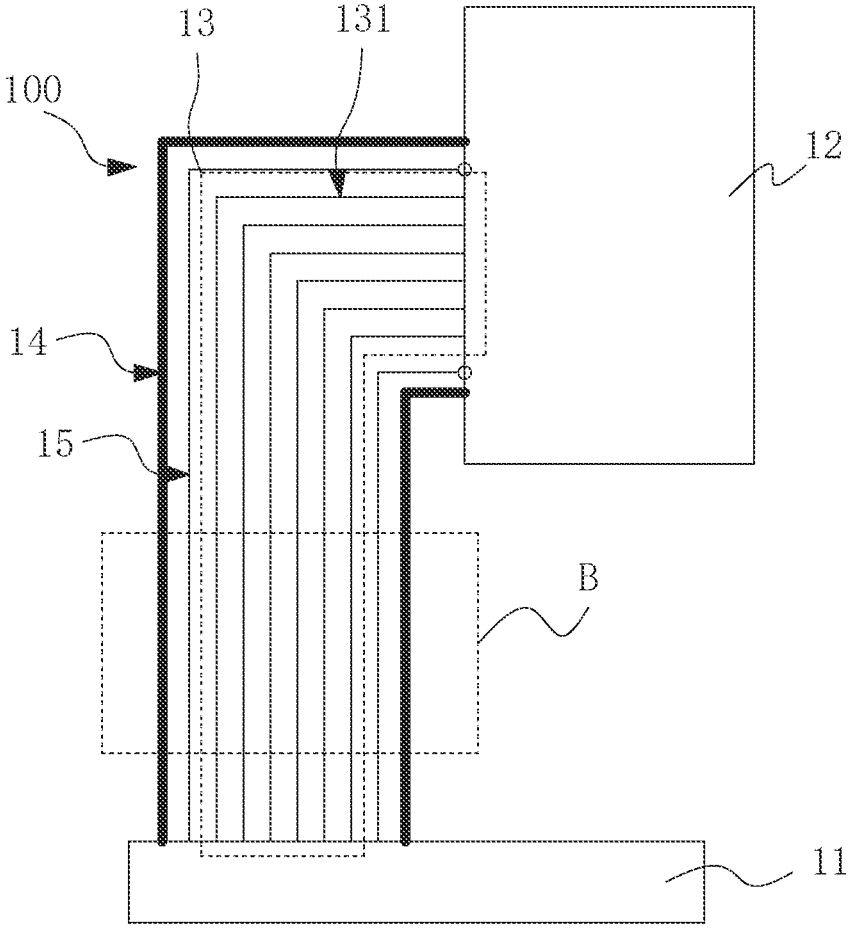
FIG. 2 is a schematic structural diagram of a driving circuit according to an embodiment of the present application.
Figure 3:
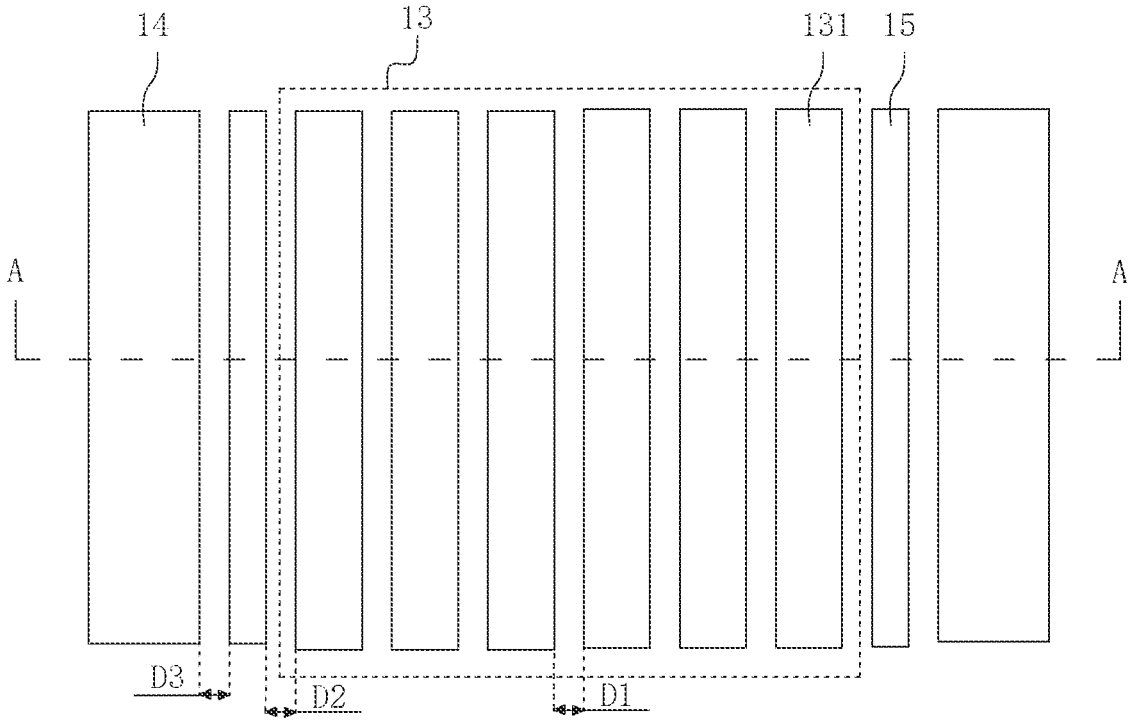
FIG. 3 is an enlarged view of part B in FIG. 2.

Referring to FIG. 2 and FIG. 3, FIG. 2 is a schematic structural diagram of a driving circuit according to an embodiment of the present application, and FIG. 3 is an enlarged view of part B in FIG. 2.

An embodiment of the present application provides a driving circuit 100, which includes a signal generator 11, a driving circuit unit 12, a clock signal line group 13, a non-high frequency signal line 14, and a redundant clock signal line 15.

The clock signal line group 13 includes a plurality of clock signal lines 131. The clock signal lines 131 are arranged side by side. There is a first pitch D1 between two adjacent clock signal lines 131. An input end of the clock signal line 131 is electrically connected to the signal generator 11, and an output end of the clock signal line 131 is electrically connected to the driving circuit unit 12.

The input end of the non-high frequency signal line 14 is electrically connected to the signal generator 11. The non-high frequency signal lines 14 are disposed on two sides of the clock signal line group 13.

An input end of the redundant clock signal line 15 is electrically connected to the signal generator 11, and an output end of the redundant clock signal line 15 is vacant. The redundant clock signal line 15 is disposed between the clock signal line group 13 and the non-high frequency signal line 14. The redundant clock signal line 15 and an adjacent clock signal line 131 have a second pitch D2.

The second pitch D2 is equal to the first pitch D1. A frequency and an amplitude of a signal received by the redundant clock signal line 15 are the same as a frequency and an amplitude of a signal received by the clock signal line 131.

The driving circuit 100 of the embodiment of the present application adds a redundant clock signal line 15 between the clock signal line group 13 and the non-high frequency signal line 14. This makes the first pitch D1 equal to the second pitch D2, and a frequency and an amplitude of a signal received by the redundant clock signal line 15 are the same as a frequency and an amplitude of a signal received by the clock signal line 131, and do not enter the plane. Because a lateral coupling capacitance is related to a distance between the two signal lines and the received voltage of the signal line. That is, under the same conditions, the greater the distance between the two, the smaller the coupling capacitance. Under the same conditions, the larger the voltage signal is, the larger the coupling capacitance is. Therefore, redundant clock signal lines 15 are added so that the distance between each clock signal line 131 and the two adjacent signal lines is equal. The redundant clock signal line 15 and the clock signal line 131 are connected to the same received voltage to ensure that the lateral capacitive coupling of the clock signal line 131 in the clock signal line group 13 is the same. This achieves an effect of balancing a load of each clock signal line, and an image shows no horizontal line defects.

In some embodiments, the output end of the redundant clock signal line 15 may also be connected to other components or circuits. As long as the signal received by the redundant clock signal line 15 does not affect an entire circuit structure.

In the driving circuit 100 of an embodiment of the present application, a width of the redundant clock signal line 15 is less than or equal to a width of the clock signal line 131. The redundant clock signal line 15 and the clock signal line group 13 are both arranged in a frame area of the driving circuit 100, so the arrangement of the redundant clock signal line 15 is convenient for shortening the frame width. In this embodiment, the width of the redundant clock signal line 15 is less than the width of the clock signal line 131, which further shortens the width of a frame.

In addition, material of the redundant clock signal line 15 is the same as material of the clock signal line 131. When both the redundant clock signal line 15 and the clock signal line 131 are in a signal transmission state, consistency of materials of the two causes a coupling effect of the clock signal line 131 to become more similar. Therefore, a load of each clock signal line 15 tends to be the same.

Optionally, material of the redundant clock signal line 15 is one of metal, metal alloy, and metal oxide. For example, copper, molybdenum alloy, and indium tin oxide.

Figure 4:
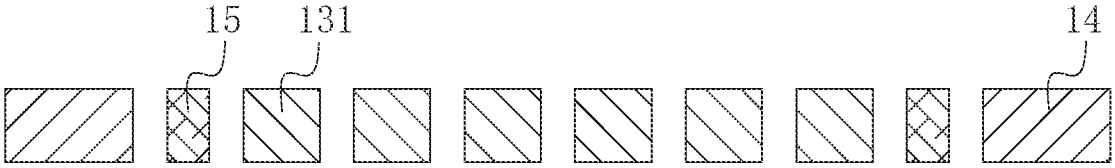
FIG. 4 is a schematic cross-sectional view taken along line AA in FIG. 3.

In an embodiment, a size of a lateral coupling capacitor also relates to areas of opposite side surfaces of the two. The larger the area, the larger the lateral coupling capacitance. Referring to FIG. 4, thicknesses of the redundant clock signal lines 15 and the clock signal lines 131 are equal, so that areas of opposite side surfaces of each clock signal line 131 and an adjacent signal line tend to be equal. Furthermore, a coupling capacitance of each clock signal line 131 and a coupling capacitance of its adjacent signal line are the same.

Specifically, the clock signal line 131 closest to a redundant clock signal line 15 is set as a first clock signal line. The clock signal line 131 closest to the first clock signal line is set as a second clock signal line. In order to make a capacitive coupling effect between the redundant clock signal line 15 and the first clock signal line and a capacitive coupling effect between the two adjacent clock signal lines 131 tend to be the same. A shape and an area of a side of the redundant clock signal line 15 facing the first clock signal line may be equal to a shape and an area of a side of the first clock signal line facing the second clock signal line.

Further, shapes and areas of two sides of the redundant clock signal line 15 correspond to shapes and areas of two sides of the clock signal line 131.

In the driving circuit 100 of an embodiment of the present application, the non-high frequency signal line 14 and the adjacent redundant clock signal line 15 have a third pitch D3. The third pitch D3 is equal to the second pitch D2. When achieving a narrow frame, the second pitch D2 is generally the minimum distance. This setting ensures that the third pitch D3 is the minimum distance to further shorten a frame width.

In some embodiments, the third pitch D3 may also be greater than the second pitch D2 to avoid the non-high frequency signal line 14 from affecting the outermost clock signal line 131.

Optionally, the non-high frequency signal line 14 is a low-frequency signal line or a DC signal line. In the driving circuit 100 of an embodiment of the present application, the non-high frequency signal line 14 is a low-frequency signal line. The driving circuit unit 12 is a gate driving circuit unit. An output end of the low-frequency signal line 14 is electrically connected to the gate driving circuit unit 12 or a common electrode (not shown in the figure). It is understood that, an element connected to the output end of the low-frequency signal line 14 may also be other elements, such as a pixel electrode, and so on.

It is understood that, in some embodiments, the driving circuit unit 12 may also be a source driving circuit unit.

In addition, in an embodiment, a number of the clock signal lines 131 is six and a number of the redundant clock signal lines 15 is two as an example, but it is not limited to this. As long as there is at least one redundant clock signal line 15 on each side of the clock signal line group 13.

In an operating process of an embodiment, the signal generator 11 generates clock signals of the same frequency and amplitude to each clock signal line 131 and redundant clock signal line 15 and generates a low-frequency signal to the non-high frequency signal line 14.

At this time, because the first pitch D1 and the second pitch D2 are equal, lateral capacitive coupling received by each clock signal line 131 tends to be the same, thereby making a load of each clock signal line 131 tend to balance.

Finally, the clock signal line 131 transmits the clock signal to the gate driving circuit unit 12, and the clock signal in the redundant clock signal line 15 does not access the gate driving circuit unit 12.

Figure 5:
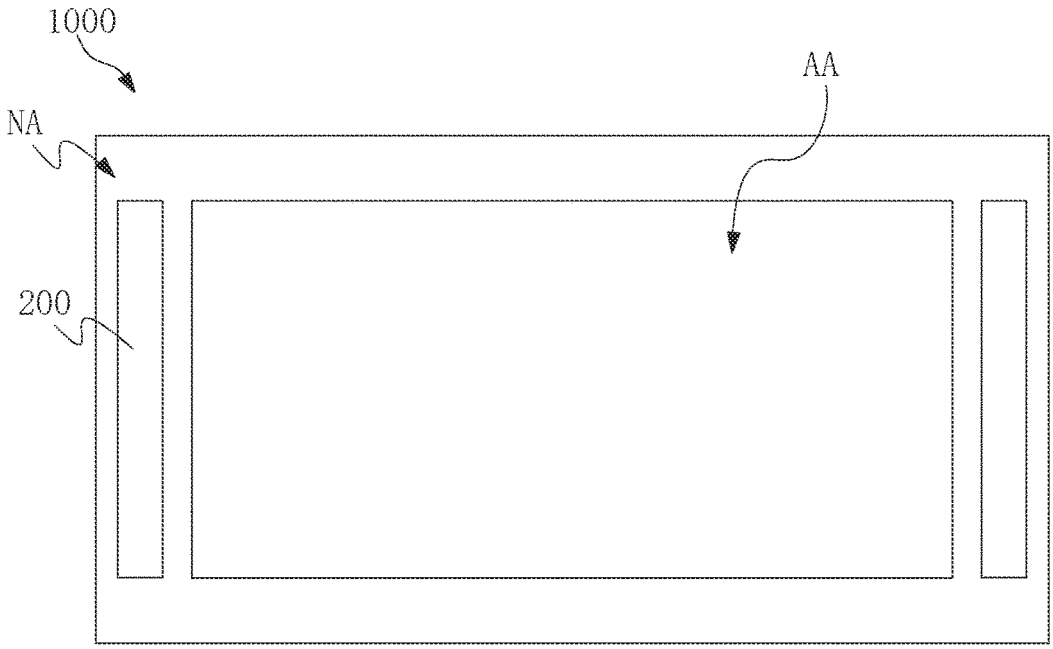
FIG. 5 is a schematic structural diagram of a display panel according to an embodiment of the present application.

An embodiment of the present application further provides a display panel 1000. In the embodiment, referring to FIG. 5, the display panel 1000 comprises a display area AA and a non-display area NA arranged around the display area AA. A driving circuit 200 is disposed in the non-display area NA. The driving circuit 200 comprises a signal generator; a driving circuit unit; a clock signal line group comprising a plurality of clock signal lines, wherein an input end of the clock signal line is electrically connected to the signal generator, and an output end of the clock signal line is electrically connected to the driving circuit unit, the clock signal lines are arranged side by side, and there is a first pitch between two adjacent clock signal lines; a non-high frequency signal line, wherein an input end of the non-high frequency signal line is electrically connected to the signal generator, and the non-high frequency signal line is provided on two sides of the clock signal line group; and a redundant clock signal line, wherein an input end of the redundant clock signal line is electrically connected to the signal generator; the redundant clock signal line is disposed between the clock signal line group and the non-high frequency signal line; a frequency and an amplitude of a signal received by the redundant clock signal line are the same as a frequency and an amplitude of a signal received by the clock signal line.

In the display panel 1000 according to an embodiment of the present application, a width of the redundant clock signal line is less than or equal to a width of the clock signal line.

In the display panel 1000 according to an embodiment of the present application, material of the redundant clock signal line is the same as material of the clock signal line.

It should be noted that a structure of the drive circuit 200 of the display panel 1000 of this embodiment is the same as a structure of the drive circuit 100 of the above embodiment.

The driving circuit and the display panel of embodiments of the present application add a redundant clock signal line between the clock signal line group and the non-high frequency signal line. A frequency and an amplitude of a signal received by the redundant clock signal line are the same as a frequency and an amplitude of a signal received by the clock signal line, and do not enter the plane. Such an arrangement makes a lateral capacitive coupling of the clock signal lines in the clock signal line group the same. This achieves an effect of balancing a load of each clock signal line, and an image shows no horizontal line defects.

The driving circuit and the display panel provided by the embodiments of the present application have been described in detail above. This article uses specific examples to explain the principles and implementation of the present application. The descriptions of the above embodiments are only used to help understand the technical solutions and core ideas of the present application. Those of ordinary skill in the art should understand that they can still modify the technical solutions described in the foregoing embodiments, or equivalently replace some of the technical features. However, these modifications or substitutions do not deviate from the scope of the technical solutions of the embodiments of the present application.

What is claimed is:

1. A driving circuit, comprising:

a signal generator;

a driving circuit unit;

a clock signal line group comprising a plurality of clock signal lines, wherein an input end of the clock signal line is electrically connected to the signal generator, and an output end of the clock signal line is electrically connected to the driving circuit unit, the clock signal lines are arranged side by side, and there is a first pitch between two adjacent clock signal lines;

a non-high frequency signal line, wherein an input end of the non-high frequency signal line is electrically connected to the signal generator, and the non-high frequency signal line is provided on two sides of the clock signal line group; and a redundant clock signal line, wherein an input end of the redundant clock signal line is electrically connected to the signal generator; the redundant clock signal line is disposed between the clock signal line group and the non-high frequency signal line; a frequency and an amplitude of a signal received by the redundant clock signal line are the same as a frequency and an amplitude of a signal received by the clock signal line;

wherein the redundant clock signal line has a second pitch with an adjacent clock signal line, the second pitch is equal to the first pitch, a width of the redundant clock signal line is less than a width of the clock signal line, the non-high frequency signal line has a third pitch with an adjacent redundant clock signal line, and the third pitch is greater than the second pitch.

2. The driving circuit according to claim 1, wherein a thickness of the redundant clock signal line and a thickness of the clock signal line are equal.

3. The driving circuit according to claim 1, wherein material of the redundant clock signal line is the same as material of the clock signal line.

4. The driving circuit according to claim 1, wherein the non-high frequency signal line is a low-frequency signal line or a DC signal line.

5. The driving circuit according to claim 4, wherein an output end of the low-frequency signal line is electrically connected to the driving circuit unit or a common electrode.

6. A display panel, comprising:

a driving circuit disposed in a non-display area of the display panel, wherein the driving circuit comprising:

a signal generator;

a driving circuit unit;

a clock signal line group comprising a plurality of clock signal lines, wherein an input end of the clock signal line is electrically connected to the signal generator, and an output end of the clock signal line is electrically connected to the driving circuit unit, the clock signal lines are arranged side by side, and there is a first pitch between two adjacent clock signal lines;

a non-high frequency signal line, wherein an input end of the non-high frequency signal line is electrically connected to the signal generator, and the non-high frequency signal line is provided on two sides of the clock signal line group; and a redundant clock signal line, wherein an input end of the redundant clock signal line is electrically connected to the signal generator; the redundant clock signal line is disposed between the clock signal line group and the non-high frequency signal line; a frequency and an amplitude of a signal received by the redundant clock signal line are the same as a frequency and an amplitude of a signal received by the clock signal line;

wherein the redundant clock signal line has a second pitch with an adjacent clock signal line, the second pitch is equal to the first pitch, a width of the redundant clock signal line is less than a width of the clock signal line, the non-high frequency signal line has a third pitch with an adjacent redundant clock signal line, and the third pitch is greater than the second pitch.

7. The display panel according to claim 6, wherein a thickness of the redundant clock signal line and a thickness of the clock signal line are equal.

8. The display panel according to claim 6, wherein material of the redundant clock signal line is the same as material of the clock signal line.

9. The display panel according to claim 6, wherein the non-high frequency signal line is a low-frequency signal line or a DC signal line.

10. The display panel according to claim 9, wherein an output end of the low-frequency signal line is electrically connected to the driving circuit unit or a common electrode.

* * * * *